US011570534B2

(12) United States Patent
Song et al.

(10) Patent No.: US 11,570,534 B2
(45) Date of Patent: Jan. 31, 2023

(54) SPEAKER DEVICE

(71) Applicant: AAC Microtech (Changzhou) Co., Ltd., Changzhou (CN)

(72) Inventors: Wei Song, Shenzhen (CN); Xin Jin, Shenzhen (CN); Zhiwei Zhong, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/533,079

(22) Filed: Nov. 22, 2021

(65) Prior Publication Data

US 2022/0174384 A1 Jun. 2, 2022

(30) Foreign Application Priority Data

Nov. 30, 2020 (CN) ..... 202022845087.6

(51) Int. Cl.
*H04R 1/02* (2006.01)
*H04R 9/02* (2006.01)
*H04R 9/06* (2006.01)

(52) U.S. Cl.
CPC ..... *H04R 1/026* (2013.01); *H04R 9/02* (2013.01); *H04R 9/025* (2013.01); *H04R 9/06* (2013.01); *H04R 2499/11* (2013.01)

(58) Field of Classification Search
CPC ..... H04R 1/026
See application file for complete search history.

(56) References Cited

U.S. PATENT DOCUMENTS

2018/0343508 A1* 11/2018 Zhang ..... H04R 1/025
2020/0213747 A1* 7/2020 Liu ..... H04R 9/045
2020/0213748 A1* 7/2020 Liu ..... H04R 9/06
2020/0275210 A1* 8/2020 Huang ..... H04R 1/2834

FOREIGN PATENT DOCUMENTS

CN 211531292 U * 9/2020 ..... H04R 9/02

OTHER PUBLICATIONS

Translation of CN 211531292 U Sep. 2020.*

* cited by examiner

*Primary Examiner* — Andrew L Sniezek
(74) *Attorney, Agent, or Firm* — W&G Law Group

(57) ABSTRACT

The present disclosure provides speaker device. speaker device includes frame and vibration unit and magnetic circuit unit respectively held to frame, where vibration unit includes diaphragm held to frame, a voice coil driving diaphragm to vibrate and produce sound and a holder; holder includes a holder body that is ring-shaped and fixed to diaphragm, first connecting portions extending from outer periphery of holder body in a direction away from diaphragm and a second connecting portion extending from inner periphery of holder body in direction away from diaphragm; voice coil is connected to second connecting portion; voice coil includes pair of first sides and pair of second sides connected between first sides; first sides are provided with elastic support members. Present disclosure can effectively reduce weight of vibration unit so as to improve sensitivity of speaker device.

8 Claims, 11 Drawing Sheets

SPEAKER DEVICE

TECHNICAL FIELD

The present disclosure relates to the field of electro-acoustic conversion, in particular to a speaker device.

BACKGROUND

In order to adapt to the miniaturization and multi-functionalization of various audio equipment and information communication equipment, the speaker devices used in such equipment are required to be miniaturized so as to closely fit with surrounding units. In particular, with the development of lighter and thinner mobile phones, the quality requirements for the speaker devices are getting higher.

In the related art, a speaker device includes a frame and a vibration unit and a magnetic circuit unit respectively held to the frame. The vibration unit includes a diaphragm, a voice coil and a holder. A side of the voice coil is provided with an elastic support member. The diaphragm is connected to the voice coil and the elastic support member through the holder. However, the weight of the vibration unit leads to low sensitivity of the speaker device.

Therefore, it is necessary to provide a speaker device to solve the above problem.

SUMMARY

An objective of the present disclosure is to provide a speaker device. The speaker device can effectively reduce the weight of a vibration unit so as to improve sensitivity.

The speaker device provided by the present disclosure includes a frame and a vibration unit and a magnetic circuit unit respectively held to the frame, where the vibration unit includes a diaphragm held to the frame, a voice coil driving the diaphragm to vibrate and produce sound, and a holder; the holder includes a holder body that is ring-shaped and fixed to the diaphragm, a first connecting portion extending from an outer periphery of the holder body in a direction away from the diaphragm and a second connecting portion extending from an inner periphery of the holder body in the direction away from the diaphragm; the voice coil is fixed to the second connecting portion, and includes a pair of first sides and a pair of second sides connected between the pair of first sides; one of the pair of first sides is provided with an elastic support member; one end of each of the elastic support members is fixed to the frame, and another end of the elastic support member is fixed to the first connecting portion; and the holder body is provided with a hollow area.

As an improvement, the magnetic circuit unit may include a yoke, a main magnetic body fixed to the yoke, an auxiliary magnetic body surrounding the main magnetic body and forming a magnetic gap with the main magnetic body, a pole plate covering the main magnetic body, and an upper splint covering the auxiliary magnetic body; and the auxiliary magnetic body may include a first magnetic portion spaced apart from one of the pair of first sides and a second magnetic portion spaced apart from one of the pair of second sides.

As an improvement, a side of the upper splint facing the diaphragm protrudes to form at least one boss; and an orthographic projection of the at least one boss along a vibrating direction of the diaphragm on the holder body may be located within the hollow area.

As an improvement, a thickness of the holder body along the vibrating direction of the diaphragm may be equal to a thickness of the at least one boss along the vibrating direction of the diaphragm.

As an improvement, the at least one boss may be formed on an inner edge of the upper splint.

As an improvement, the upper splint may include a first splint portion covering the first magnetic portions and a second splint portion covering the second magnetic portion; and each of the first splint portion and the second splint portion may be provided with at least one boss.

As an improvement, the first magnetic portions and the second magnetic portions may be formed into one piece.

As an improvement, each of the first magnetic portion and the second magnetic portion may be provided with two permanent magnets that are spaced apart from each other.

As an improvement, the elastic support members and the pair of the first sides enclose an accommodating space; the first magnetic portion may be located in the accommodating space; the elastic support member may include an auxiliary diaphragm; the auxiliary diaphragm may be provided with an avoiding groove; the first magnetic portion may include a main body portion and an extension portion extending into the avoiding groove from a side of the main body portion away from one of the pair of first sides; and the first connecting portion may be provided with a notch for avoiding the extension portion.

As an improvement, the auxiliary diaphragm may include a first fixing portion fixed to the frame, a second fixing portion connected to the first connecting portion, and a suspension portion connecting the first fixing portion and the second fixing portion; and the avoiding groove extends onto the suspension portion from a side of the second fixing portion away from the first fixing portion.

Compared with the related art, in the present disclosure, by providing a hollow area on the holder body and retaining part of the material of the holder body to provide sufficient support strength, the present disclosure effectively reduces the weight of the vibration unit, thereby improving the sensitivity of the speaker device.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF EMBODIMENTS

Figure 1:
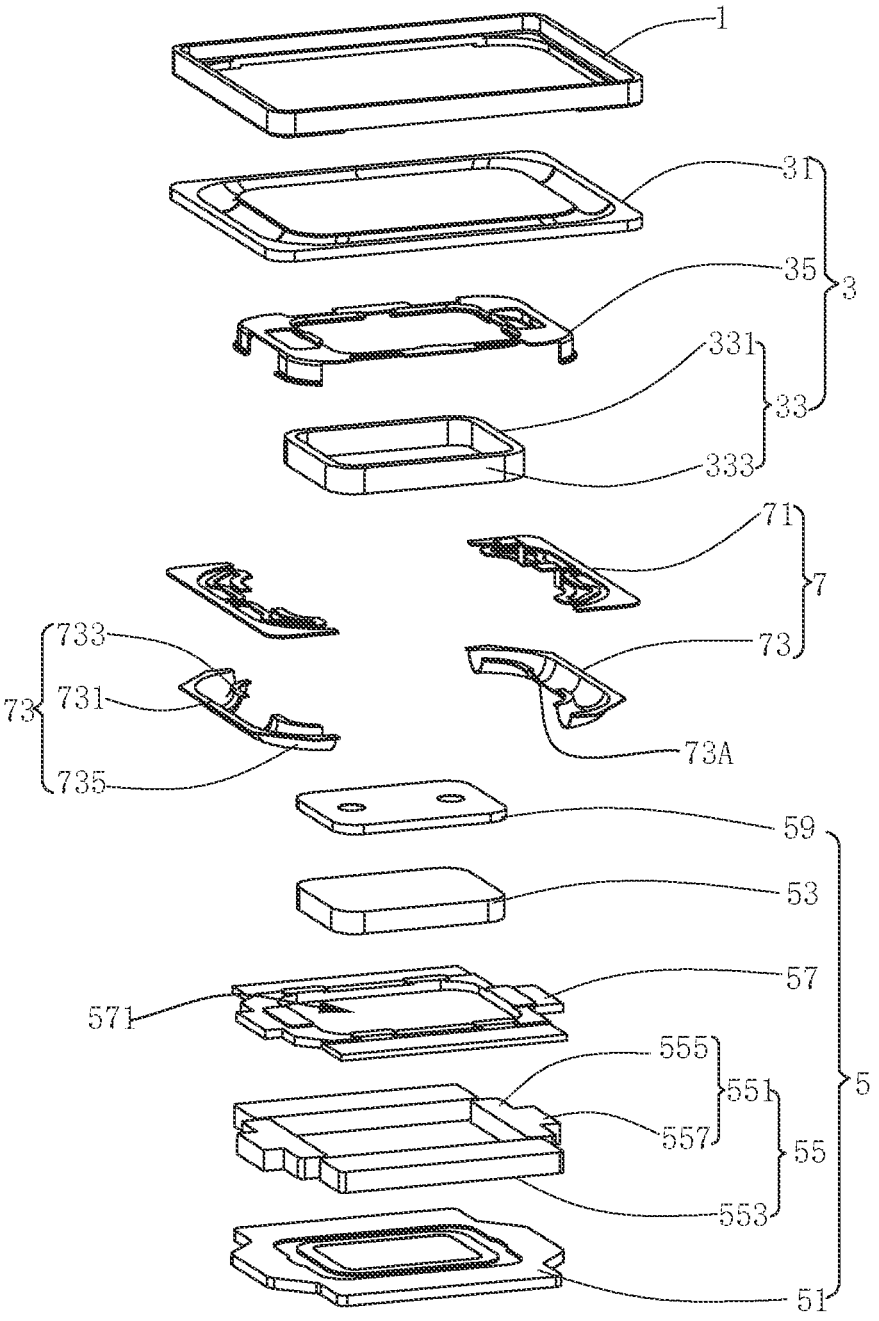
FIG. 1 is a three-dimensional exploded view illustrating a structure of a speaker device according to a preferred embodiment of the present disclosure.
Figure 2:
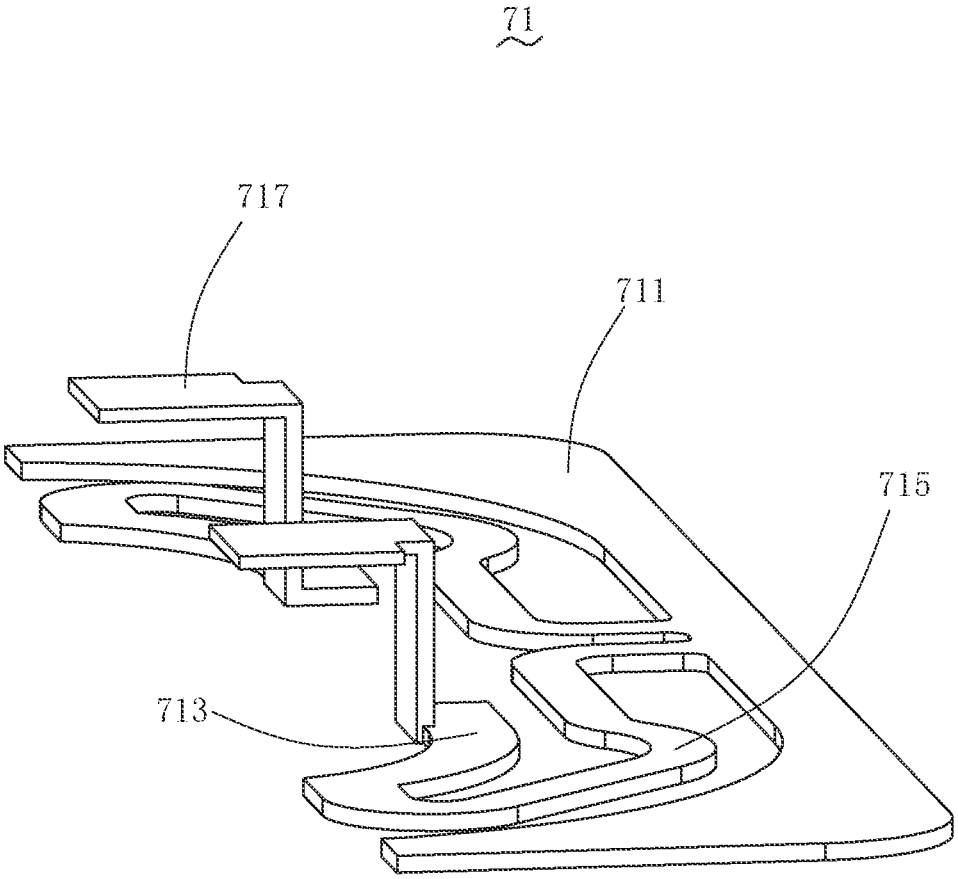
FIG. 2 is a view illustrating a structure of a flexible printed circuit (FPC) of the speaker device shown in FIG. 1.
Figure 3:
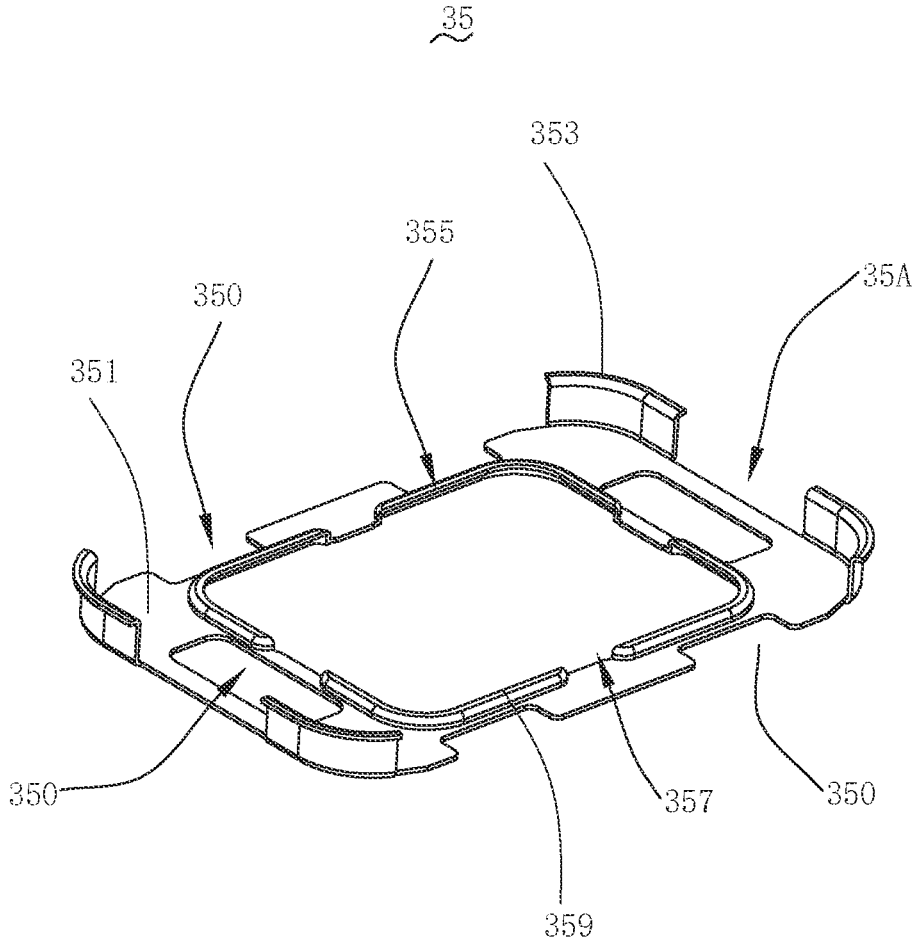
FIG. 3 is a view illustrating a structure of a holder of the speaker device shown in FIG. 1.
Figure 4:
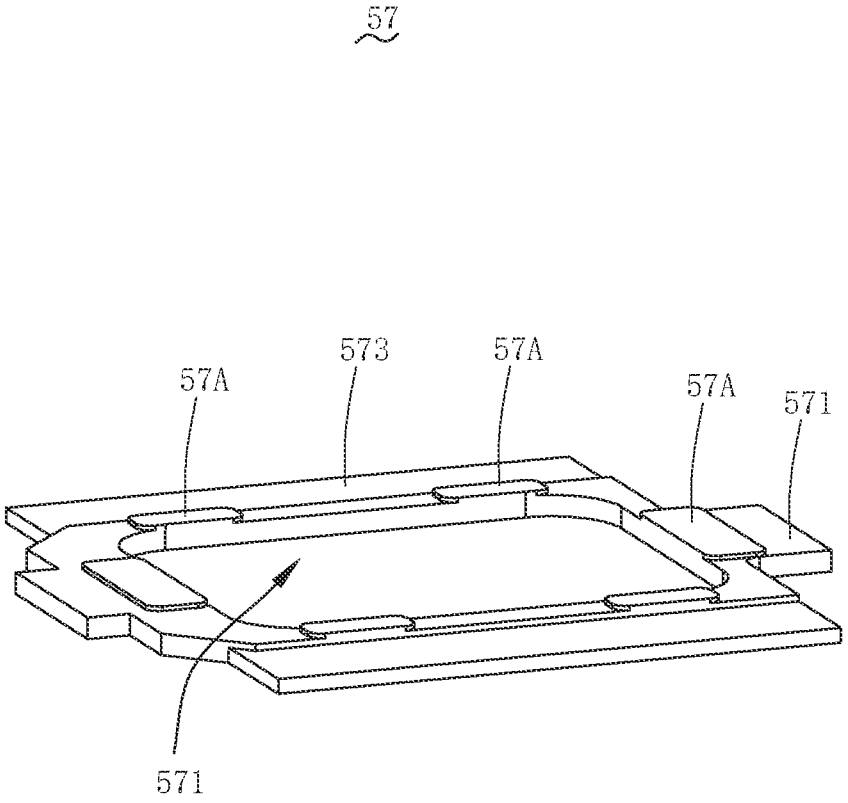
FIG. 4 is a view illustrating a structure of an upper splint of the speaker device shown in FIG. 1.
Figure 5:
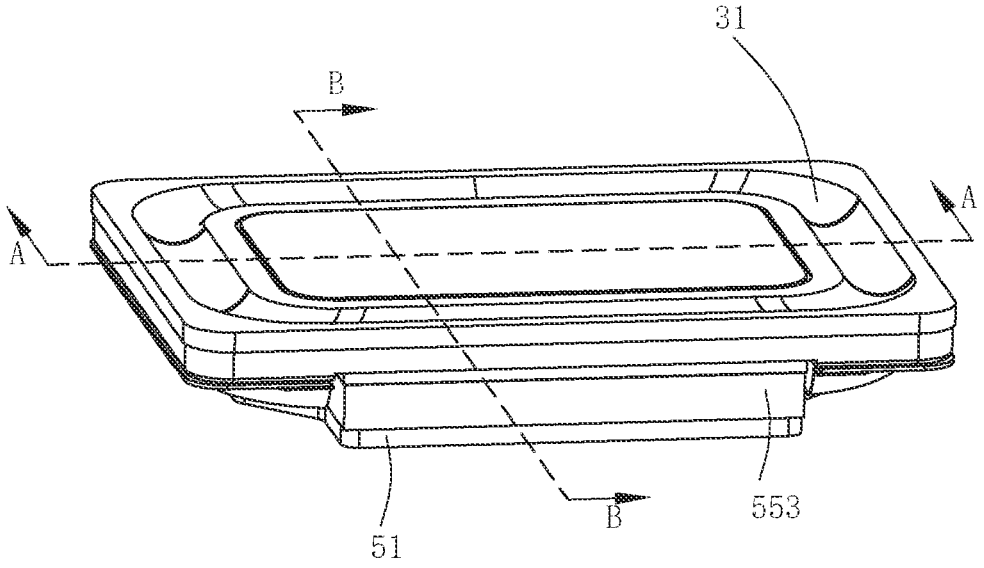
FIG. 5 is a three-dimensional view of the speaker device shown in FIG. 1 after assembly.

The technical solutions in the embodiments of the present disclosure are clearly and completely described below with reference to the drawings in the embodiments of the present disclosure. Apparently, the embodiments described are a part, rather than all of the embodiments of the present disclosure. All other embodiments obtained by those of ordinary skill in the art based on the embodiments in the present disclosure without creative efforts should fall within the protection scope of the present disclosure.

As shown in FIGS. 1 to 11, a speaker device includes a frame 1, and a vibration unit 3 and a magnetic circuit unit 5 respectively fixed to the frame 1. The magnetic circuit unit 5 drives the vibration unit 3 to vibrate and produce sound.

The vibration unit 3 includes a diaphragm 31 fixed to the frame 1, a voice coil 33 driving the diaphragm 31 to vibrate and produce sound and a holder 35. The voice coil 33 is connected to an external circuit. After the voice coil 33 is energized, the voice coil 33 vibrates under the action of a magnetic field of the magnetic circuit unit 5.

The holder 35 includes a holder body 351 that is ring-shaped and fixed to the diaphragm 31, a first connecting portion 353 extending from an outer periphery of the holder body 351 in a direction away from the diaphragm 31 and a second connecting portion 355 extending from an inner periphery of the holder body 351 in the direction away from the diaphragm 31. The holder body 351 is provided with a hollow area 350. The first connecting portion 353 is connected to elastic support member 7. The voice coil 33 is connected to the second connecting portion 355. The voice coil 33 drives the diaphragm 31 to vibrate and produce sound through the holder 35, and the holder 35 drives the elastic support members 7 to vibrate together.

In this embodiment, the second connecting portion 355 is provided with a plurality of gaps 357. The plurality of gaps 357 divide the second connecting portion 355 into a plurality of isolation portions 359 that are spaced apart from each other. The voice coil 33 is fixed to the plurality of isolation portions 359. When the voice coil 33 is connected to the second connecting portion 355, the gap 357 enable an air flow channel between the voice coil 33 and the second connecting portion 355 to balance an air pressure in the speaker device during vibration.

Figure 8:
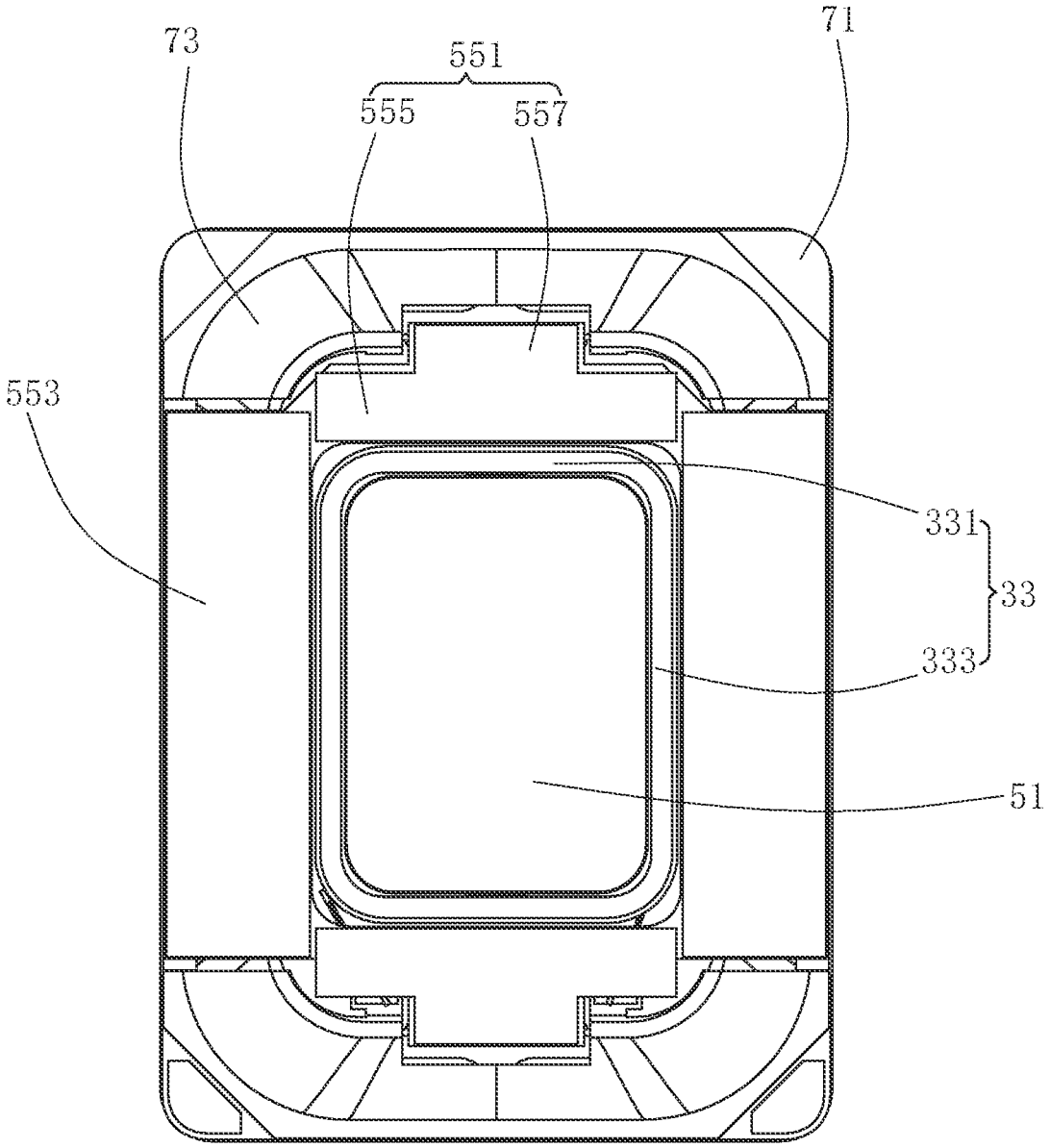
FIG. 8 is a view illustrating a structure of the speaker device (with a yoke removed) shown in FIG. 5 from another angle.
Figure 9:
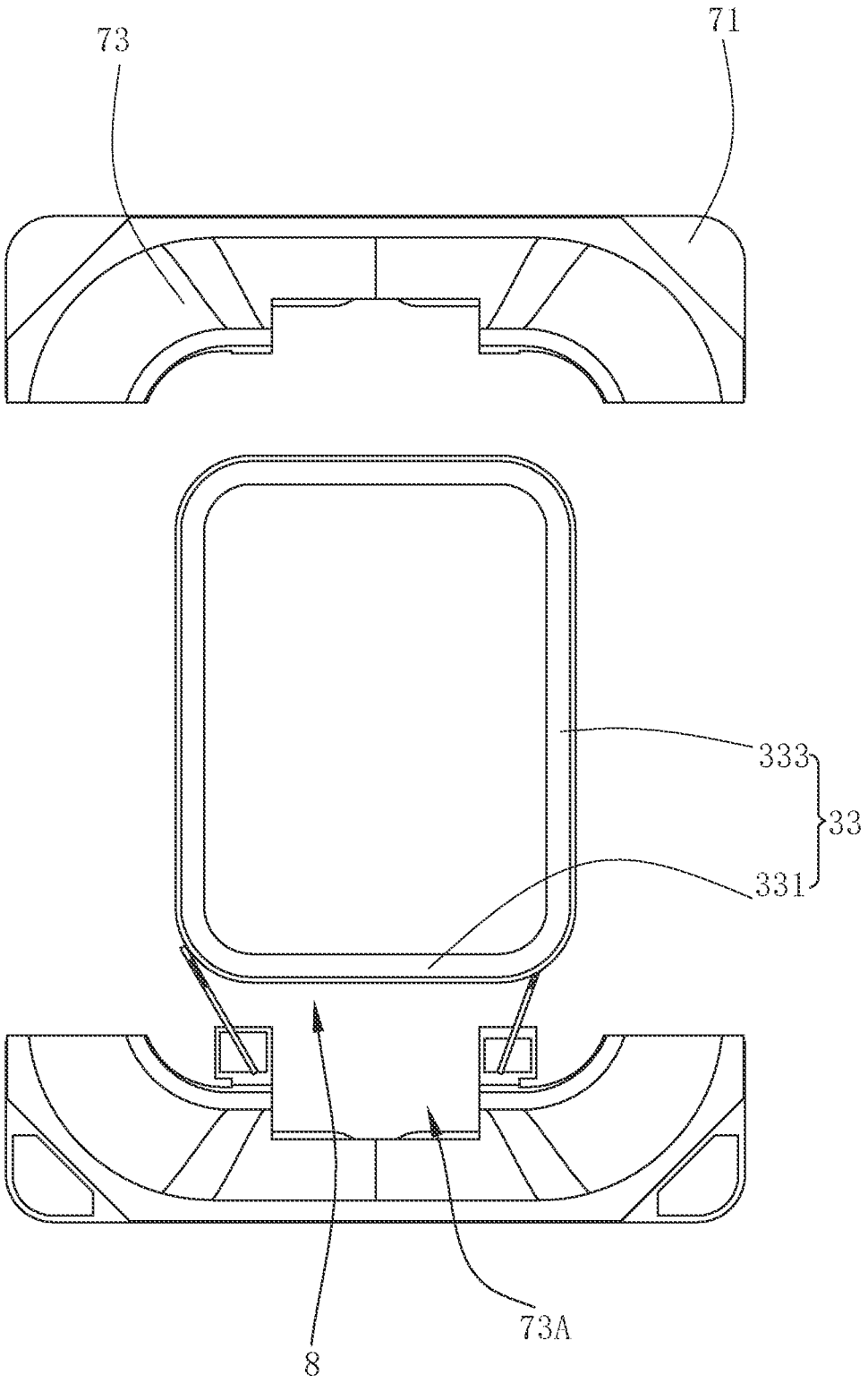
FIG. 9 is a view illustrating a structure of elastic support members and a voice coil of the speaker device shown in FIG. 1 after assembly.
Figure 10:
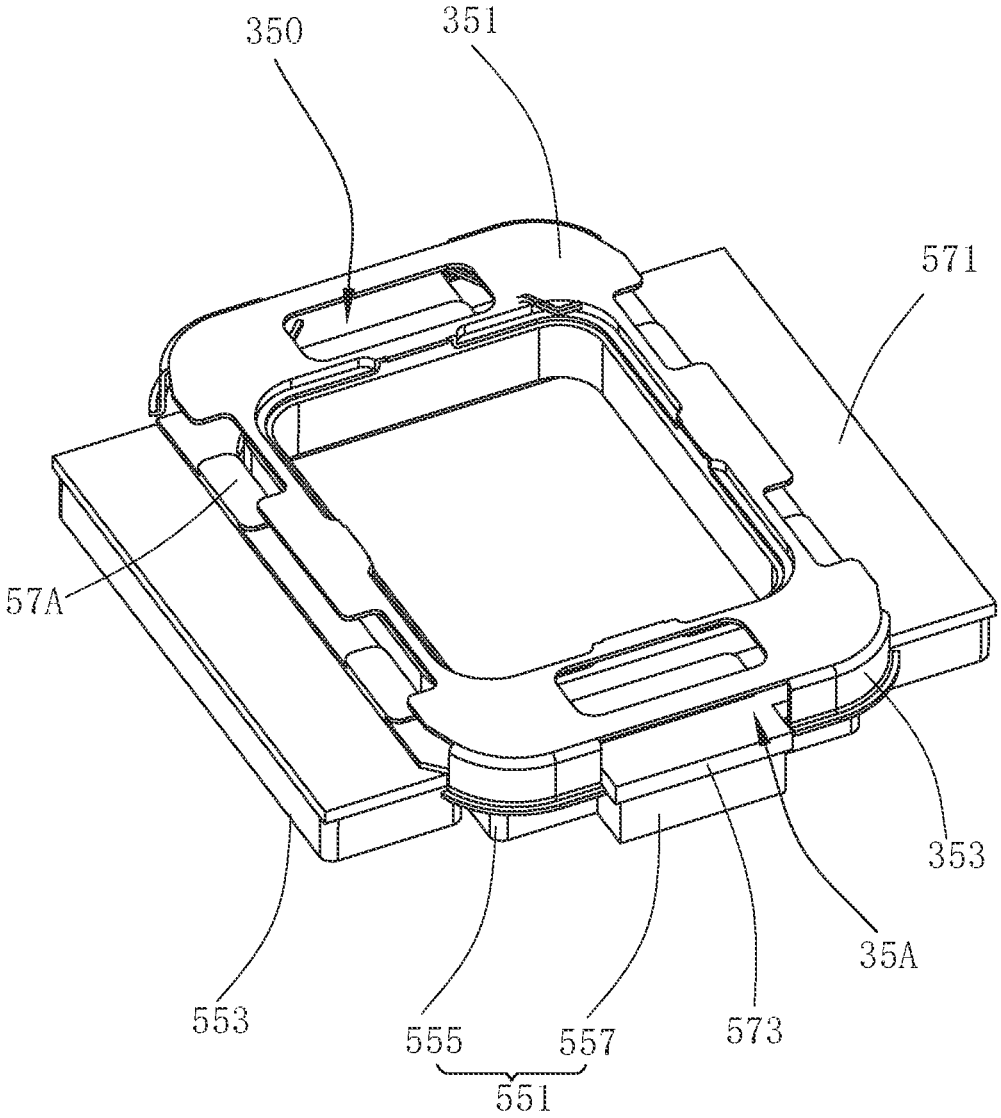
FIG. 10 is a three-dimensional view of the upper splint, an auxiliary magnetic body and the holder of the speaker device shown in FIG. 1 after assembly.
Figure 11:
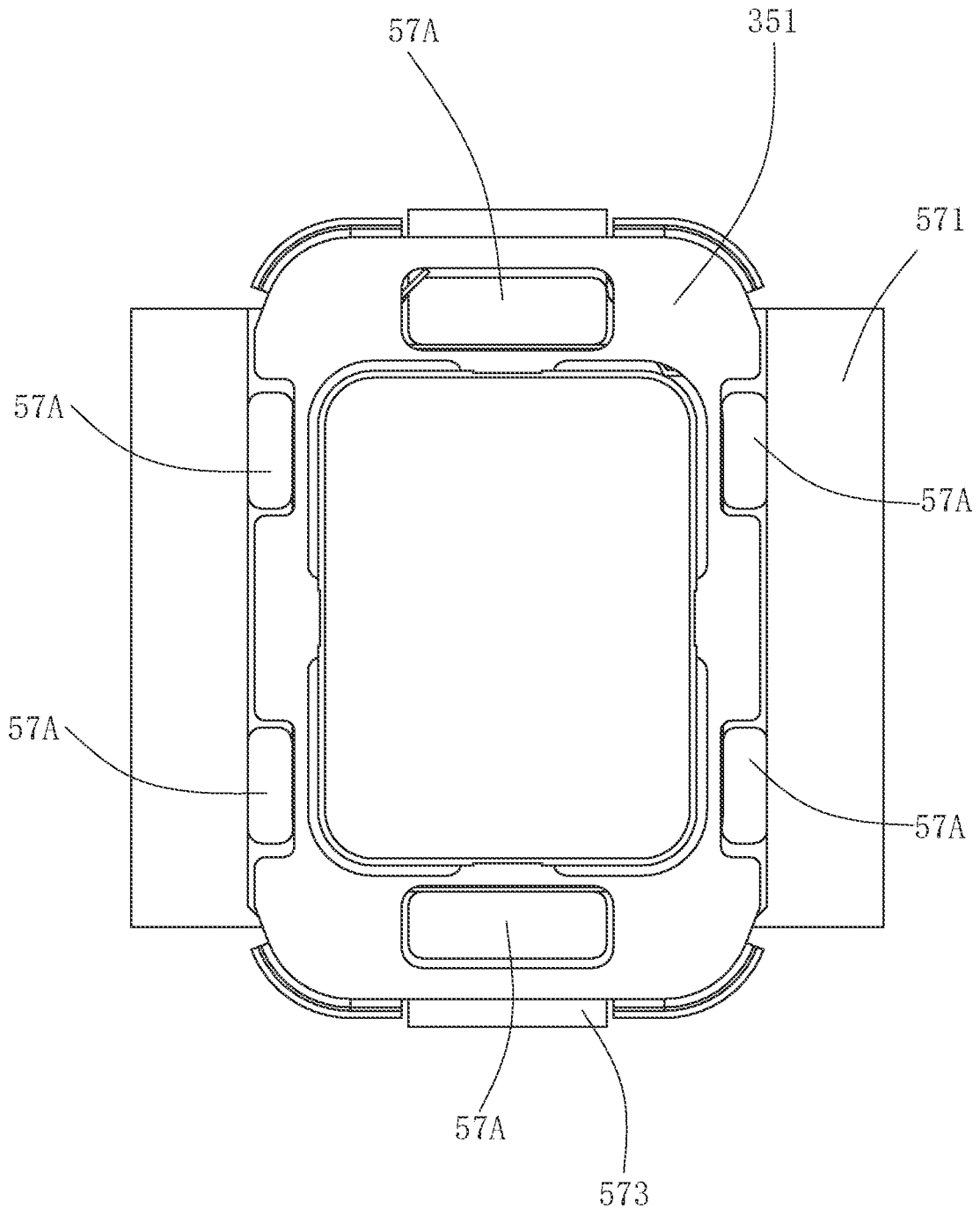
FIG. 11 is a top view of the upper splint, the auxiliary magnetic body and the holder of the speaker device shown in FIG. 1 after assembly.

The voice coil 33 includes a pair of first sides 331 and a pair of second sides 333, each of the pair of the second sides is connected between the first sides 331. As shown in FIGS. 1, 8 and 9, the first side 331 is located in a long axis direction of the speaker device, and the second side 333 is located in a short axis direction of the speaker device.

The first side 331 is provided with the elastic support member 7. One end of the elastic support member 7 is fixed to the frame 1, and the other end thereof is fixed to a corresponding first connecting portion 353. The elastic support member 7 and the first side 331 enclose the accommodating space 8.

The elastic support member 7 includes a flexible printed circuit (FPC) 71 and an auxiliary diaphragm 73 stacked along a vibrating direction of the diaphragm 31.

Figure 6:
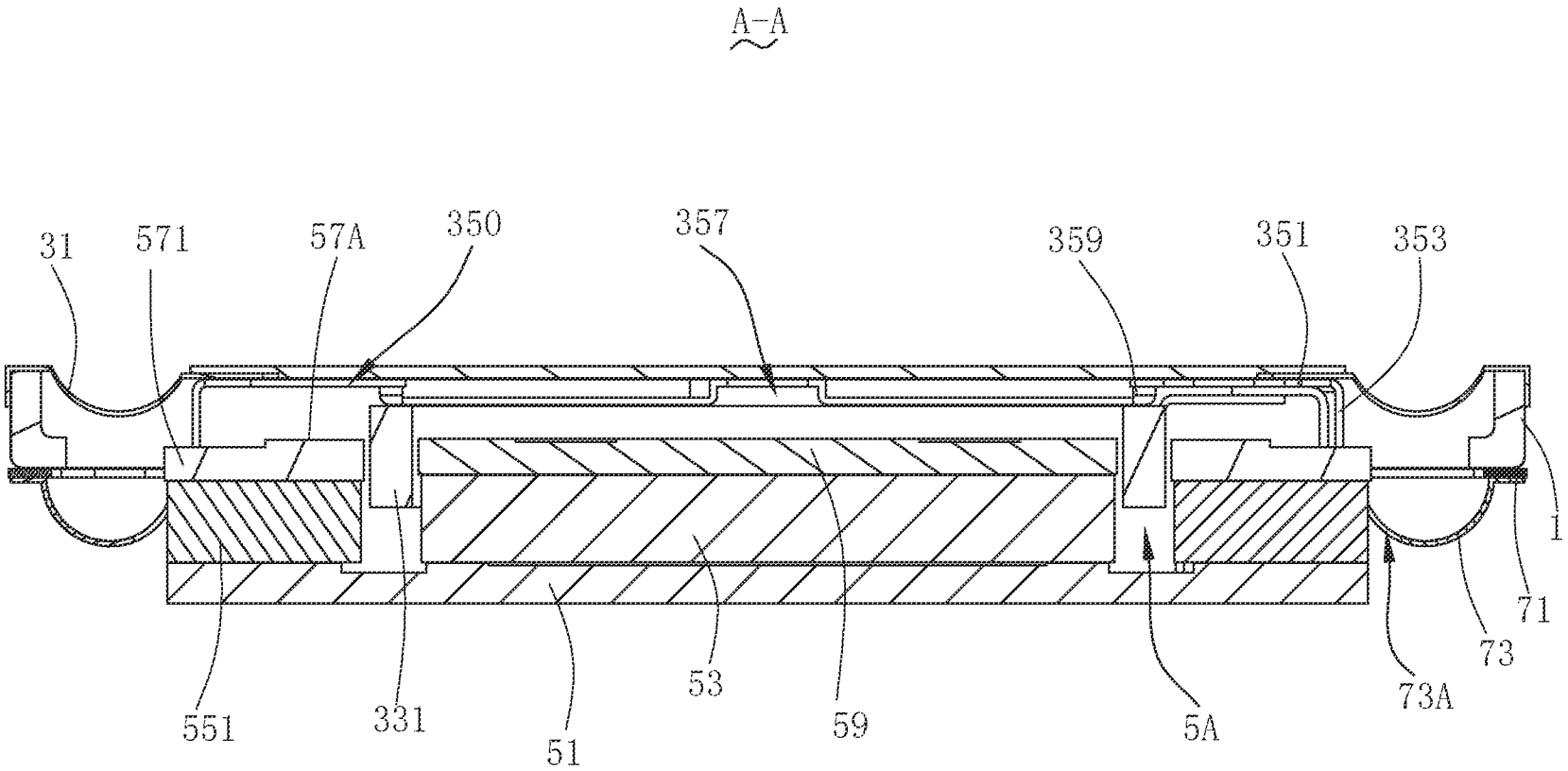
FIG. 6 is a sectional view of the speaker device taken along line A-A shown in FIG. 5.
Figure 7:
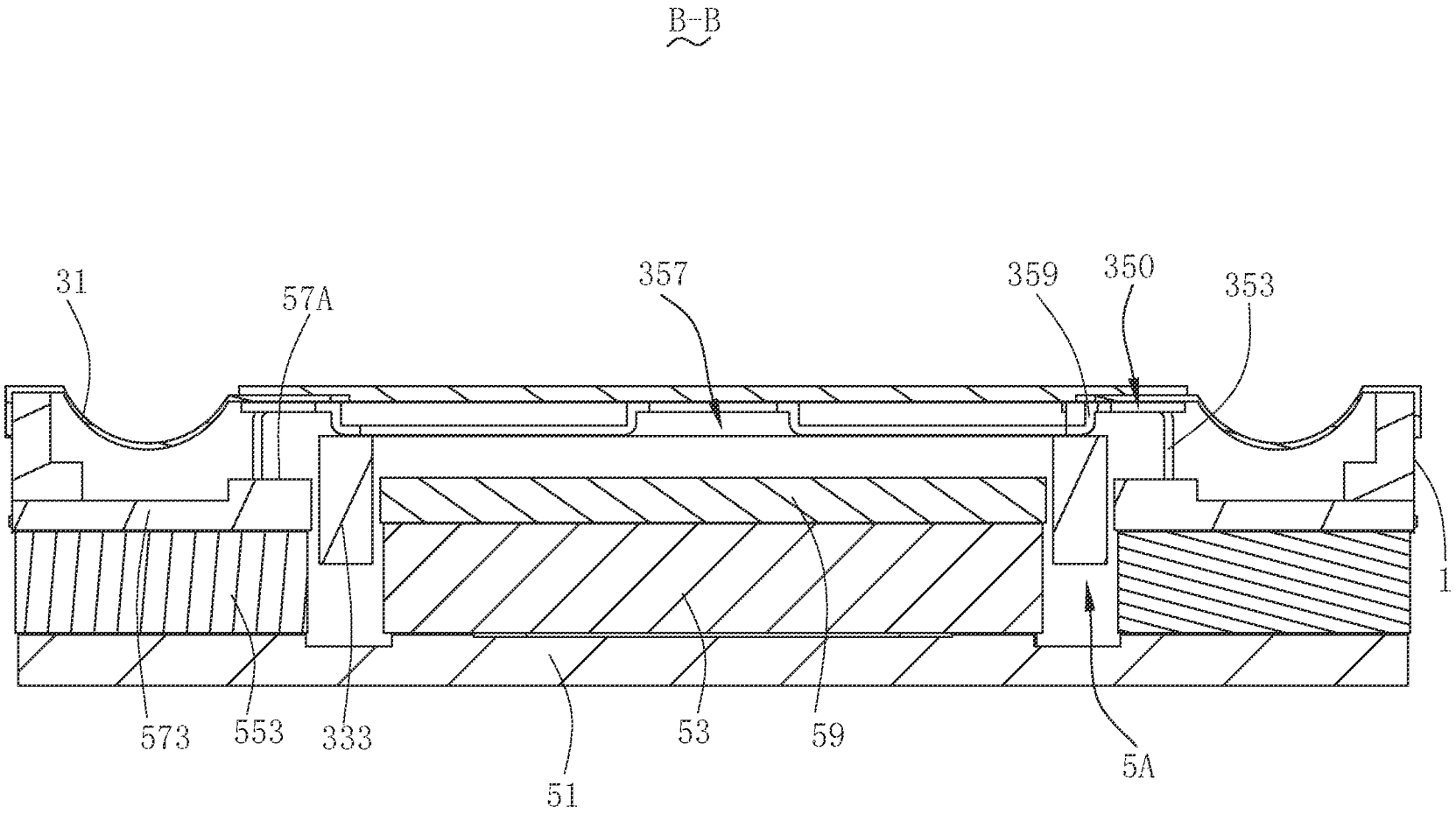
FIG. 7 is a sectional view of the speaker device taken along line B-B shown in FIG. 5.

As shown in FIG. 6, the FPC 71 is located between the auxiliary diaphragm 73 and the diaphragm 31.

The FPC 71 includes a holding portion 711 fixed to the frame 1, a coupling portion 713 fixed to the first connecting portion 353 and an elastic arm 715 connecting the holding portion 711 and the coupling portion 713.

In this embodiment, an FPC 71 further includes a pad portion 717 bending and extending from the coupling portion 713 to the diaphragm 31. The pad portion 717 is provided with a pad electrically connected to a lead wire of the voice coil 33. The FPC 71 functions to support and fix the vibration unit 3. In addition, each of the holding portion 711 and the pad portion 717 of the FPC 71 are provided with the pad (not shown). The elastic arm 715 and the coupling portion 713 are provided therein with a conductive path to electrically connect the pads on the holding portion 711 and the pad portion 717. The pad on the pad portion 717 is connected to the lead wire of the voice coil 33, so as to electrically connect the voice coil 33. The pad on the holding portion 711 is connected to the external circuit, such that the voice coil 33 is electrically connected to the external circuit through the FPC 71. When the speaker device is working, an electrical signal of the external circuit is transmitted to the voice coil 33 through the FPC 71.

It is understandable that, in other implementations, the FPC 71 may not include the pad portion. Correspondingly, the pad electrically connected to the lead wire of the voice coil 33 is provided on the coupling portion.

The auxiliary diaphragm 73 includes a first fixing portion 731 fixed to a side of the holding portion 711 away from the frame 1, a second fixing portion 733 fixed to a side of the coupling portion 713 away from the first connecting portion 353 and a suspension portion 735 connecting the first fixing portion 731 and the second fixing portion 733. An opening of the suspension portion 735 faces the FPC, and orthographic projection of the elastic arm 715 on the auxiliary diaphragm 73 is located within the suspension portion 735. That is, the first fixing portion 731 of the auxiliary diaphragm 73 is fixed to the frame 1 through the holding portion 711, and the second fixing portion 733 of the auxiliary diaphragm 73 is fixed to the first connecting portion 353 through the coupling portion 713.

It is understandable that, in other implementations, the elastic support member may be provided in such a manner that the auxiliary diaphragm is located between the FPC and the diaphragm. Correspondingly, the opening of the suspension portion faces away from the diaphragm. Alternatively, the elastic support members each may only include the auxiliary diaphragm.

The magnetic circuit unit 5 includes a yoke 51, a main magnetic body 53 and an auxiliary magnetic body 55 fixed to the yoke 51, an upper splint 57 covering the auxiliary magnetic body 55 and a pole plate 59 covering the main magnetic body 53. The auxiliary magnetic body 55 encloses the main magnetic body 53 and forms a magnetic gap 5A with the main magnetic body 53. The upper splint 57 is held to the frame 1 so as to hold the magnetic circuit unit 5 to the frame 1. The voice coil 33 is inserted in the magnetic gap 5A, such that when the voice coil 33 is energized, the voice coil 33 vibrates under the action of the magnetic field of the magnetic circuit unit 5. The upper splint 57 is provided with a through hole 571, and the pole plate 59 is located in the through hole 571. The upper splint 57 and the pole plate 59 are respectively made of a magnetically conductive material. The magnetic conductivity of the upper splint 57 and the pole plate 59 enhances a magnetic flux in the magnetic gap 5A.

The auxiliary magnetic body 55 includes a first magnetic portion 551 that is spaced apart from the first side 331 and located in the accommodating space 8 and a second magnetic portion 553 spaced apart from the second side 333.

As shown in FIG. 1, each of the first magnetic portions 551 and the second magnetic portions 553 is provided with two permanent magnets that are spaced apart from each other. It is understandable that, in other implementations, the first magnetic portion 551 and the second magnetic portion 553 may be formed into one piece, that is, the auxiliary magnetic body 55 may be provided in a continuous ring-shaped structure.

In this embodiment, the main magnetic body 53, the first magnetic portion 551 and the second magnetic portion 553 are magnets. Certainly, as another implementation of the main magnetic body 53, the first magnetic portion 551 and the second magnetic portion 553, the main magnetic body 53 may also include two main magnets. The two main magnets are stacked along the vibrating direction of the diaphragm 31, and polarities of the two main magnets are opposite. Correspondingly, the first magnetic portions 551 and the second magnetic portions 553 may respectively include two auxiliary magnets. The two auxiliary magnets are stacked along the vibrating direction of the diaphragm 31, and polarities of the two auxiliary magnets are opposite. Alternatively, a magnetic conductor made of a magnetically conductive material may be sandwiched between the two main magnets and the two auxiliary magnets.

A side of the upper splint 57 facing the diaphragm 31 protrudes to form the boss 57A. Orthographic projection of the boss 57A along the vibrating direction of the diaphragm 31 on the holder body 351 is located within the hollow area 350. By thickening the position of the upper splint 57 facing the hollow area 350, the magnetic conductivity of the upper splint 57 is improved, thereby enhancing the magnetic flux in the magnetic gap 5A.

A greater thickness of the bosses 57A leads to better magnetic conductivity. However, in order to prevent the diaphragm 31 from colliding with the bosses 57A to cause damage to the diaphragm 31 during vibration, the thickness of the bosses 57A along the vibrating direction of the diaphragm 31 is not greater than that of the holder body 351 along the vibrating direction of the diaphragm 31. In this embodiment, the thickness of the holder body 351 along the vibrating direction of the diaphragm 31 is equal to that of the boss 57A along the vibrating direction of the diaphragm 31.

In this embodiment, the boss 57A is formed on an inner edge of the upper splint 57. In this way, the utilization of the magnetic conductivity of the boss 57A is maximized.

The upper splint 57 includes first splint portion 571 covering the first magnetic portion 551 and second splint portion 573 covering the second magnetic portion 553. The first splint portion 571 and the second splint portion 573 are respectively provided with at least one boss 57A.

In this embodiment, the auxiliary diaphragm 73 is provided with an avoiding groove 73A. The first magnetic portion 551 include a main body portion 555 and an extension portion 557 extending from a side of the main body portion 555 away from the first side 331 into the avoiding groove 73A. The first connecting portion 353 is provided with a notch 35A for avoiding the extension portion 557. Through the avoiding groove 73A provided on the auxiliary diaphragm 73 and the notch 35A provided on the first connecting portion 353, the first magnetic portion 551 extends into the avoiding groove 73A. In this way, the present disclosure can increase the volume of the magnetic circuit unit so as to increase a BL value, i.e. a force factor of the speaker device. In addition, by removing the material in the notch 35A area of the holder, the present disclosure can effectively reduce the weight of the vibration unit so as to improve the sensitivity of the speaker device.

As shown in FIGS. 1 and 6, the avoiding groove 73A extends from a side of the second fixing portion 733 away from the first fixing portion 731 to the suspension portion 735.

The above described are merely implementations of the present disclosure. It should be noted here that those of ordinary skill in the art may make improvements without departing from the concept of the present disclosure, but such improvements should fall within the protection scope of the present disclosure.

What is claimed is:

1. A speaker device, comprising a frame, and a vibration unit and a magnetic circuit unit respectively held to the frame, wherein the vibration unit comprises a diaphragm held to the frame, a voice coil driving the diaphragm to vibrate and produce sound, and a holder; the holder comprises a holder body that is ring-shaped and fixed to the diaphragm, a first connecting portion extending from an outer periphery of the holder body in a direction away from the diaphragm and a second connecting portion extending from an inner periphery of the holder body in the direction away from the diaphragm; the voice coil is fixed to the second connecting portion, and comprises a pair of first sides and a pair of second sides connected between the pair of first sides; one of the pair of first sides is provided with an elastic support member; one end of the elastic support member is fixed to the frame, and another end of the elastic support member is fixed to the first connecting portion; and the holder body is provided with a hollow area, the magnetic circuit unit comprises a yoke, a main magnetic body fixed to the yoke, an auxiliary magnetic body surrounding the main magnetic body and forming a magnetic gap with the main magnetic body, a pole plate covering the main magnetic body, and an upper splint covering the auxiliary magnetic body; and the auxiliary magnetic body comprises a first magnetic portion spaced apart from one of the pair of first sides and a second magnetic portion spaced apart from one of the pair of second sides, a side of the upper splint facing the diaphragm protrudes to form at least one boss; and an orthographic projection of the at least one boss along a vibrating direction of the diaphragm on the holder body is located within the hollow area.

2. The speaker device as described in claim 1, wherein a thickness of the holder body along the vibrating direction of the diaphragm is equal to a thickness of the at least one boss along the vibrating direction of the diaphragm.

3. The speaker device as described in claim 1, wherein the at least one boss is formed on an inner edge of the upper splint.

4. The speaker device as described in claim 1, wherein the upper splint comprises a first splint portion covering the first magnetic portion and a second splint portion covering the second magnetic portion; and each of the first splint portion and the second splint portion is provided with at least one boss.

5. The speaker device as described in claim 1, wherein the first magnetic portion and the second magnetic portion are formed into one piece.

6. The speaker device as described in claim 1, wherein each of the first magnetic portion and the second magnetic portion is provided with two permanent magnets that are spaced apart from each other.

7. The speaker device as described in claim 1, wherein the elastic support member and the pair of first sides enclose an accommodating space; the first magnetic portion is located in the accommodating space; the elastic support member comprises an auxiliary diaphragm; the auxiliary diaphragm is provided with an avoiding groove; the first magnetic portion comprises a main body portion, and an extension portion extending into the avoiding groove from a side of the main body portion away from one of the pair of first sides; and the first connecting portion is provided with a notch for avoiding the extension portion.

8. The speaker device as described in claim 7, wherein the auxiliary diaphragm comprises a first fixing portion fixed to the frame, a second fixing portion connected to the first connecting portion, and a suspension portion connecting the first fixing portion and the second fixing portion; and the avoiding groove extends onto the suspension portion from a side of the second fixing portion away from the first fixing portion.

* * * * *